United States Patent [19]

DeLigt

[11] Patent Number: 4,500,376

[45] Date of Patent: Feb. 19, 1985

[54] METHOD OF USING A VENEER BUTT-END SPLICER

[75] Inventor: John DeLigt, Covington, Va.

[73] Assignee: Westvaco Corporation, New York, N.Y.

[21] Appl. No.: 502,658

[22] Filed: Jun. 9, 1983

Related U.S. Application Data

[62] Division of Ser. No. 356,491, Mar. 9, 1982, Pat. No. 4,421,591.

[51] Int. Cl.[3] ..... B31F 5/00; G03D 15/04

[52] U.S. Cl. ..... 156/159; 156/304.1; 156/507; 156/508; 156/509; 156/511; 156/519

[58] Field of Search ..... 156/159, 304.1, 304.6, 156/502, 507, 508, 509, 511, 519

[56] References Cited

U.S. PATENT DOCUMENTS 2,516,602 7/1950 Snyder ..... 156/507

3,962,016 6/1976 Alfter et al. ..... 156/304.6

*Primary Examiner*—Jay H. Woo

*Assistant Examiner*—Timothy W. Heitbrink

*Attorney, Agent, or Firm*—W. A. Marcontell; R. L. Schmalz

[57] ABSTRACT

Wood veneer strips are butt joined end-to-end for assembly of an indefinite length strip or sheet suitable for reeling. The splicing apparatus clamps the veneer strip ends to be joined in longitudinal planar alignment for trimming by two spaced shear knives having parallel cutting planes. Following the shear cut, a reciprocating carriage for one bed knife to which one veneer strip is clamped is withdrawn from the corresponding cutting plane to permit movement of all shear knife structure from between the carriage and the other, fixed position bed knife without retracting the shear knife edges back past the bed knife edges. The reciprocating carriage is then moved along with its corresponding bed knife and clamped veneer strip into abutment with the fixed position bed knife and respective strip edge where lap splice material is laid across the joint and cured in place under heat and pressure.

4 Claims, 5 Drawing Figures

METHOD OF USING A VENEER BUTT-END SPLICER

This is a division of application Ser. No. 356,491, filed Mar. 9, 1982, now U.S. Pat. No. 4,421,591.

BACKGROUND OF THE INVENTION

1. Field of the Invention

The present invention relates to methods and apparatus for joining the ends of wood veneer strips.

2. Background of the Invention

The objective of wood veneering includes the lamination of a thin slice of expensive, furniture grade wood to the face of a structural substrate to obtain the esthetic grain and texture surface qualities of the expensive wood. Such veneer slices may be as thin as 0.010 inch, in random widths up to 24 inches and 8 to 10 feet long.

Width and length limitations on veneer slices are dictated by the characteristics of the tree from which the veneer wood is derived. Preferred veneer wood tree species rarely have continuously straight trunk sections in excess of 10 feet. Curved portions of a trunk, knots and limb sections are unsuitable for veneer shaving.

As classically applied by individual craftsmen, veneer length limitations created little difficulty since the veneer surface was not relied upon for structural integrity and the substrate provided a suitable surface against which adjacent strips may be butt or finger joined.

In recent years, veneer usage has been applied to articles of high production volume thereby requiring continuous or semi-continuous material supply lines. Responsively, veneer strips are lap sliced together with fiberglass scrim and hot-melt adhesive to produce continuous length sheets or tapes of any desired length which are reeled for shipment, marketing and use.

For a quality product of continuous length veneer, the adjoining edges of adjacent strips must exactly match along the common joint line.

The prior art technique for obtaining such exact joint matches has been to lap the ends of two veneer lengths over the cutting edge of a bed knife to cut both edges with the same stroke of the same shear knife.

This technique has proven less than satisfactory due to splintering and pulling of the lapped edges during the shear stroke.

It is, therefore, an object of the present invention to disclose a method and apparatus capable of shearing the ends of separate veneer strips along a precisely matching butt line.

Another object of the present invention is to disclose a machine that shears and joins the butt ends of two veneer strips under positive position control.

SUMMARY

These and other objects of the invention are accomplished by a machine having two, parallel shear knives and respective bed knives for simultaneously cutting respective veneer strip edges with a single shear stroke. Veneer material clamps are associated with two table surfaces on opposite sides of the shear knife cutting planes for firmly securing the position of the veneer strips during the shear stroke. One bed knife and corresponding clamp is laterally movable to and from the respective shear knife plane. Following the shear stroke, the shear knife assembly continues to travel below the table level to permit closure of the reciprocating bed knife against the fixed bed knife thereby butting the respectively sheared veneer edges together. While in abutment, adhesive and lap splice material are applied across the butt joint and cured in place under a heated pressure plate which swings in the shear plane against the joint.

BRIEF DESCRIPTION OF THE DRAWINGS

Relative to the drawings wherein like reference characters designate like or similar elements throughout the several figures of the drawings.

DESCRIPTION OF THE PREFERRED EMBODIMENT

Figure 1:
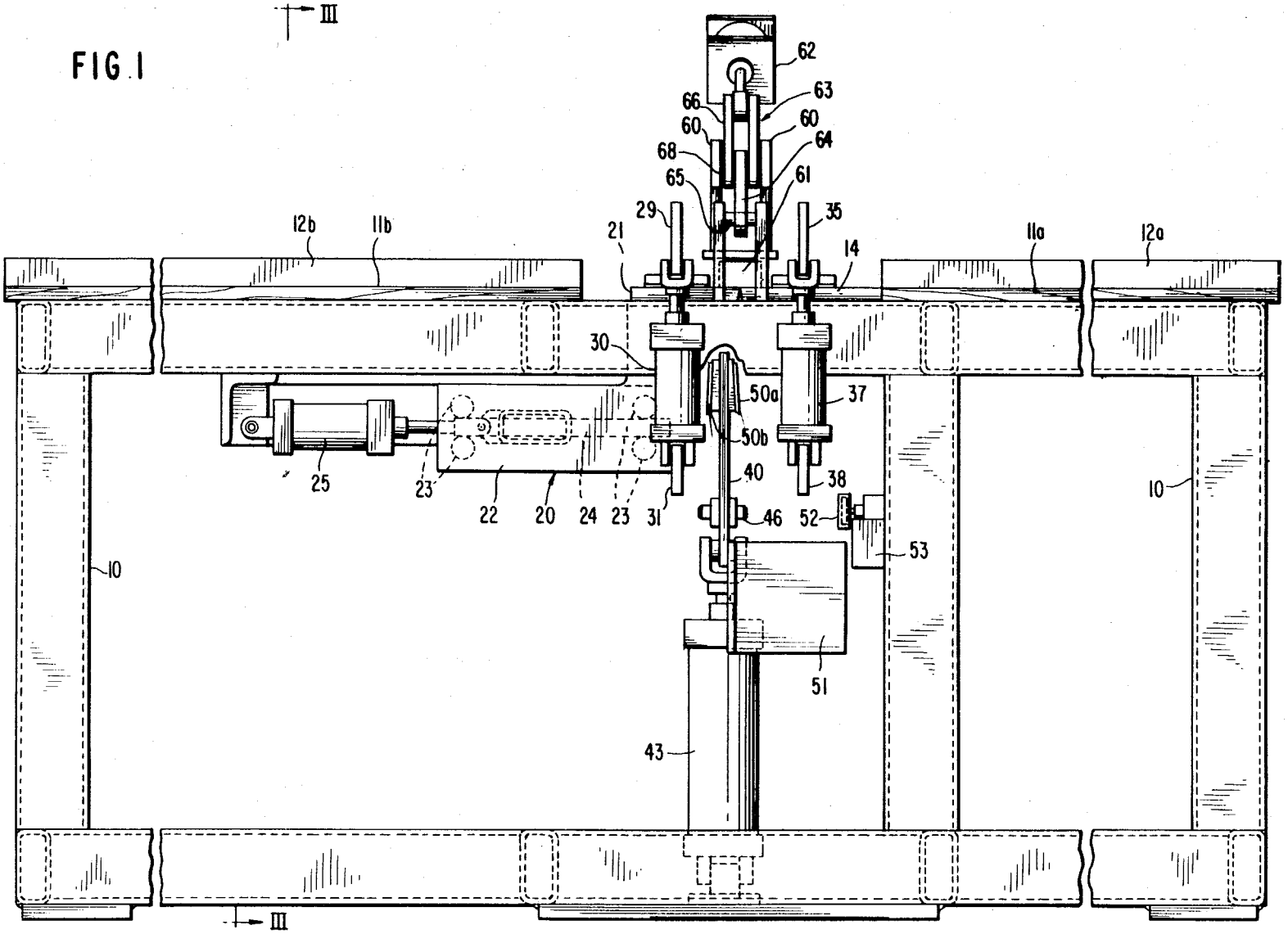
FIG. 1 is a front elevational view of the present invention.
Figure 2:
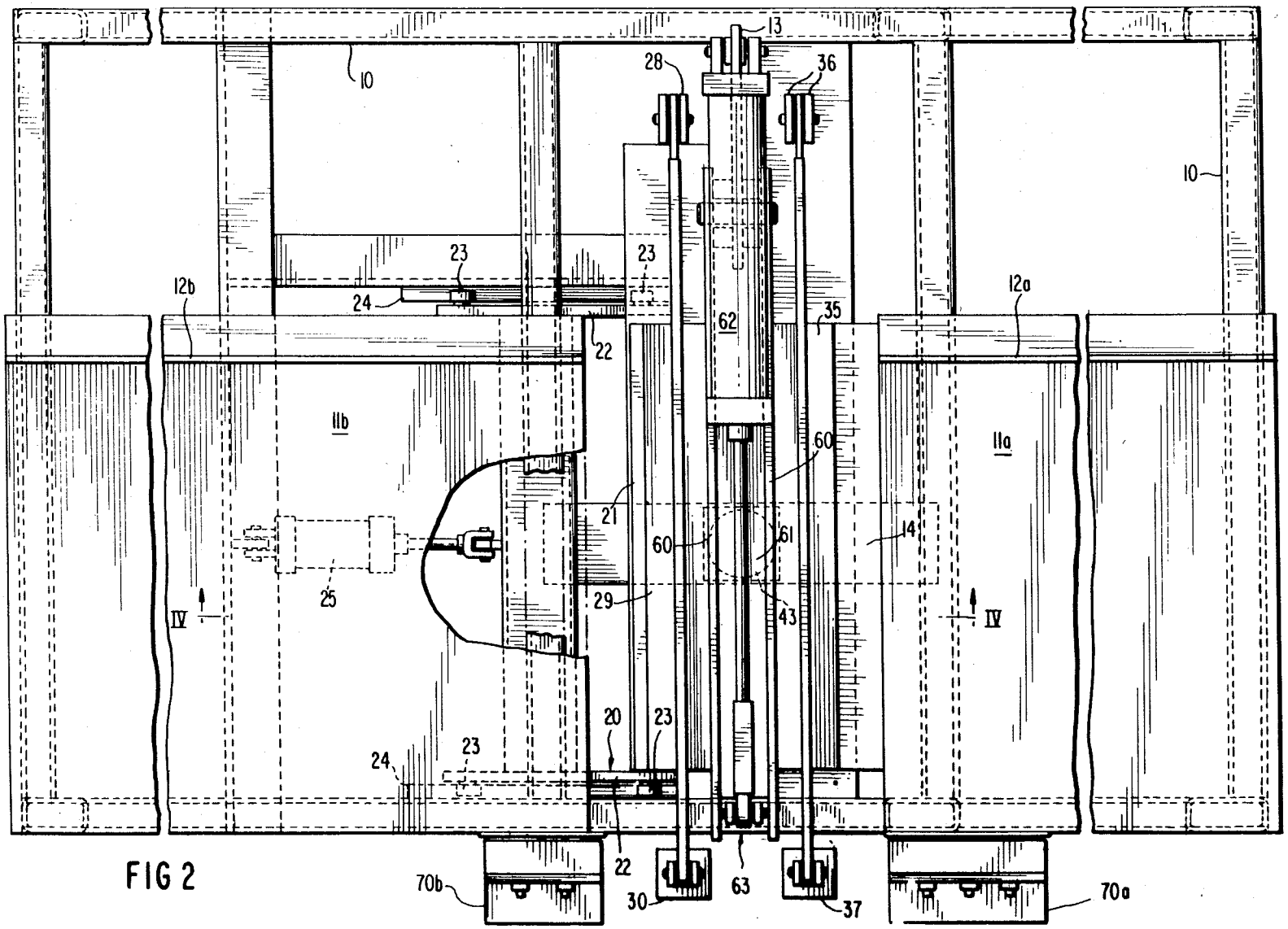
FIG. 2 is a top plan view of the present invention.
Figure 3:
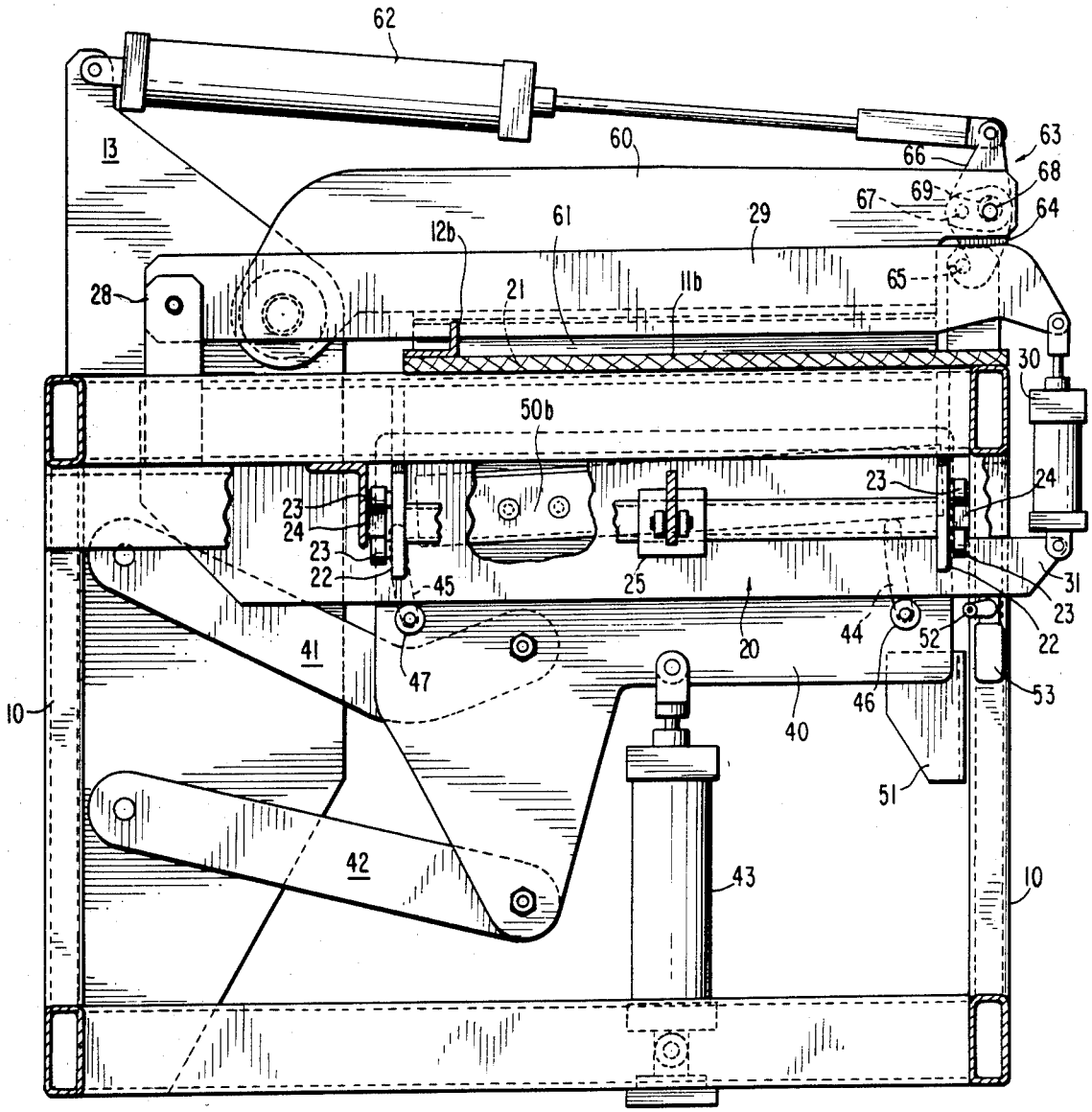
FIG. 3 is a sectioned end elevational view of the present invention taken along cutting plane III—III of FIG. 1.

Viewing the overall layout of the invention from FIGS. 1 and 2, the operative elements are positionally secured within an open space frame 10 having table surfaces 11*a*, 11*b* and back-fence sections 12*a*, 12*b*. In the proximity of the shear plane and parallel therewith is a frame bracket 13 (FIG. 3).

Coplanar with the top of righthand table surface 11*a* on the right side of the righthand shear plane is a fixed bed knife 14. The cutting edge of fixed bed knife 14 defines the righthand shear plane.

Between the righthand edge of the left table surface 11*b* and the righthand shear plane is a space within which the reciprocating bed knife 21 is disposed to shuttle between abutment with the shear plane edge of the fixed plane knife 14 and the righthand edge of left table surface 11*b*.

Reciprocating bed knife 21 is secured to a shuttle carriage 20 having front and back roller plates 22. Four rollers 23 on each plate 22 ride the top and bottom surfaces of front and back guide bars 24. Driving the carriage 20 between the two extreme positions is an appropriate reversible linear motor 25 such as a double-acting hydraulic piston/cylinder.

Also secured to the shuttle carriage 20 on the backside thereof is a hinge bracket 28 which pivots a T-bar clamp 29. Engagement of the T-bar clamp 29 against the face of a veneer strip on table surface of bed knife 21 is controlled by a reversible linear motor such as double-acting hydraulic piston/cylinder 30. The reaction end of piston/cylinder 30 is secured to a hinge bracket 31 mounted on the front side of shuttle carriage 20.

T-bar clamp 35 serves the righthand table surface 11*a*. The back end of clamp 35 is hinged to bracket 36 and the front end is controlled by reversible linear motor 37 pivoted from hinge bracket 38. Both hinge brackets 36 and 38 are secured to frame 10.

Figure 4:
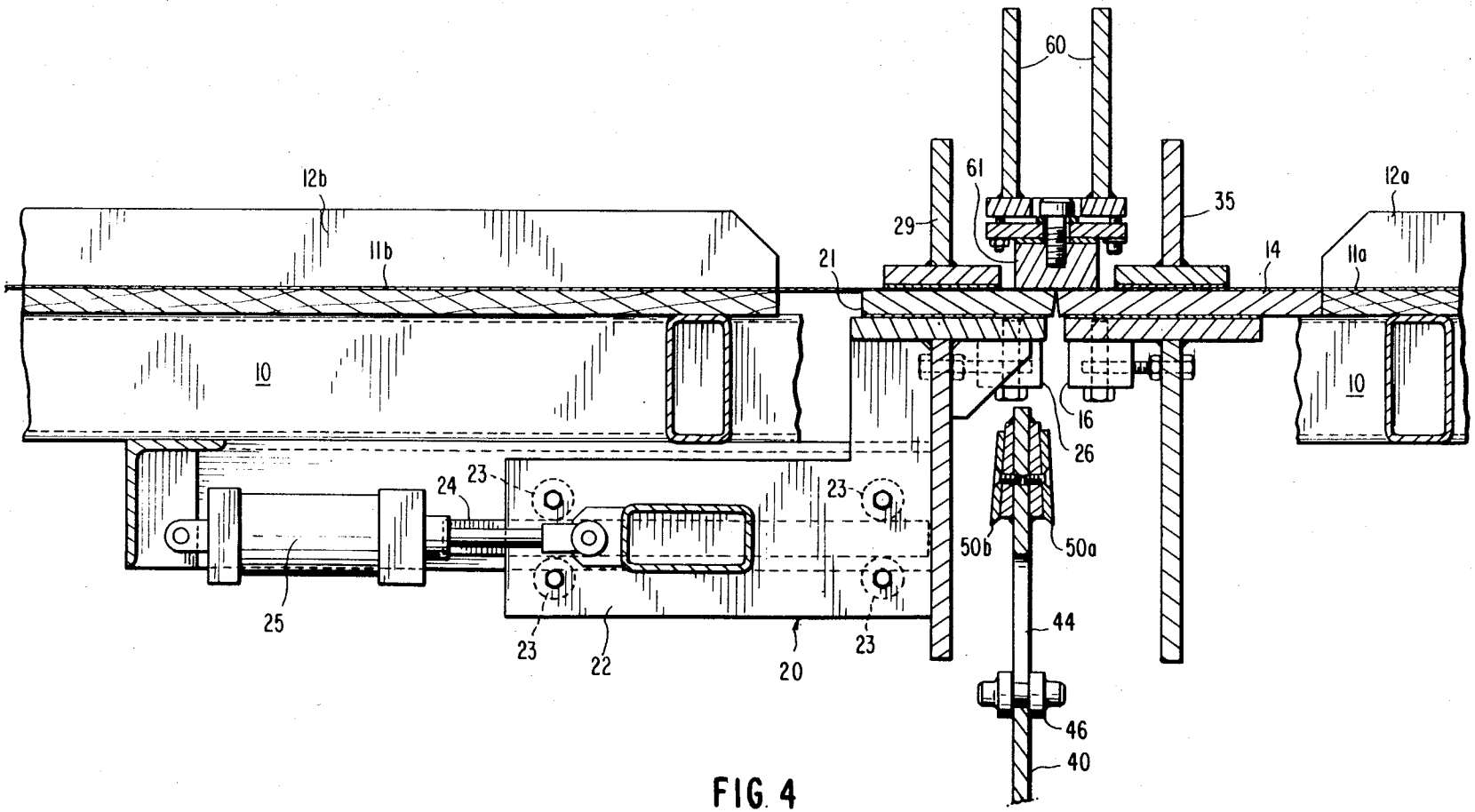
FIG. 4 is a partial section of the invention taken along cutting plane IV—IV of FIG. 2.
Figure 5:
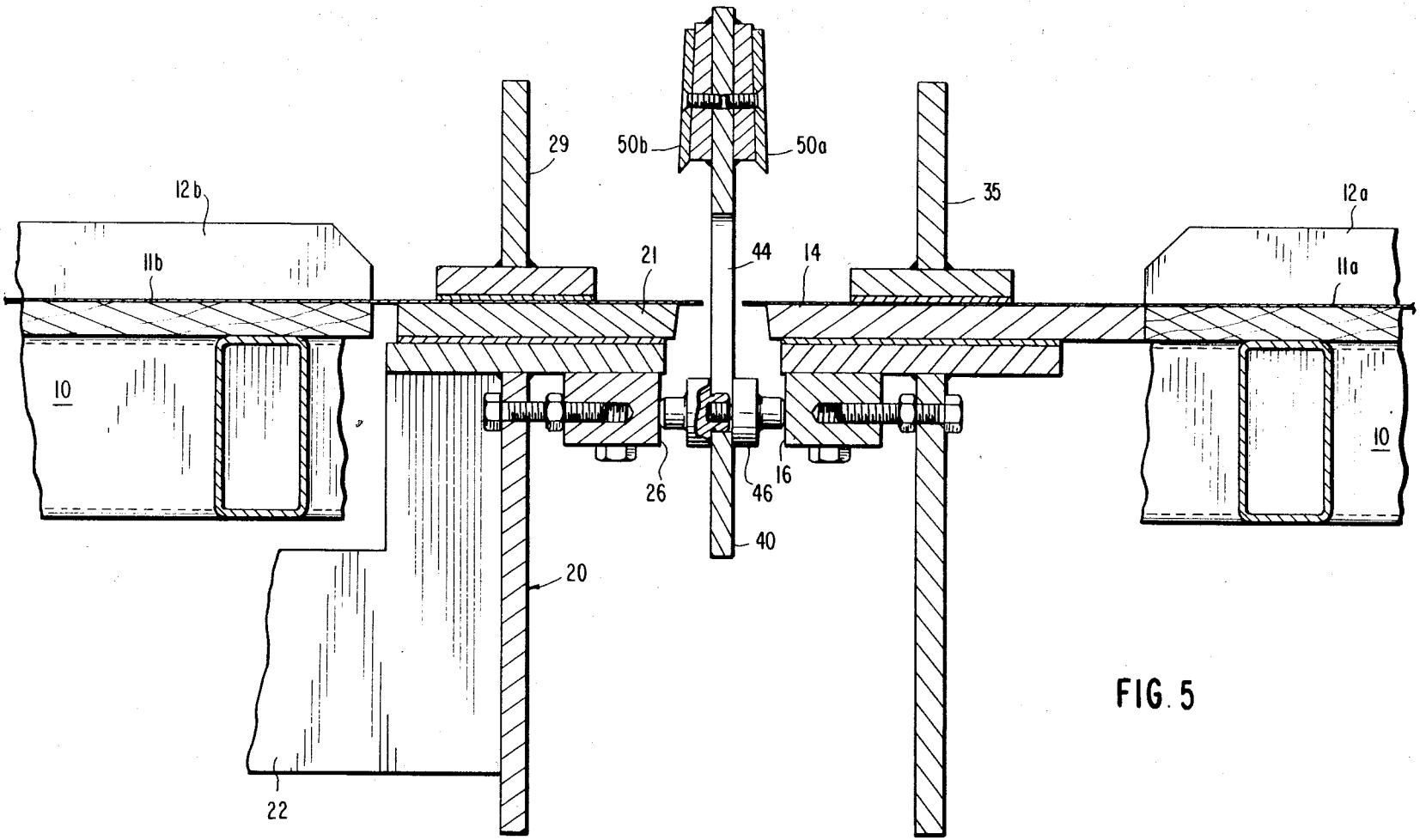
FIG. 5 is a partial section of the invention taken along cutting plane IV—IV of FIG. 2 except that the shear knife is shown above the table in preparation for a shear stroke.

As best seen in FIG. 3, shear plate 40 is mounted for vertical plane translation by top and bottom link bars 41 and 42. Translation force is provided by reversible linear motor 43 which drives the shear plates 40 between the upper and lower limit positions illustrated by FIGS. 5 and 4 respectively.

Within the front and back edges of shear plate 40 are guide slots 44 and 45. Loosely positioned through the guide slots 44 and 45 are spacer buttons 46 and 47.

Secured to opposite faces of the shear plate 40 along the top edge thereof are right and left shear knives 50*a* and 50*b*.

Extending laterally from the front edge of shear plate 40 is a cam plate 51 to engage the follower arm 52 of limit switch 53 within a predetermined arc segment between the shear plate 40 translation limits. The switch 53 and follower arm 52 are mounted directly to the frame 10.

Hinged to the frame bracket 14 above the table surface is a swing arm 60 which carries an electrically heated pressure plate 61 into parallel engagement with a veneer strip face positioned on the machine table surface.

Driving the swing arm 60 between the engagement and retraction positions is a double-acting linear motor 62 which is hinged at its reaction end to the frame bracket 13. The rod end of the motor 62 is hinged to an over-center cam latch mechanism 63. As the motor 62 reaches the limit end of its out-stroke to position the swing arm down against the table 11, latch hook 64 is pivoted to engage latch bar 65 which is secured to frame 10. Final extension of the motor 62 out-stroke wedges the hook 64 into complete engagement to multiply the end-load force of the swing arm 60 against the table 11.

To release the latch and raise the swing arm 60, initial motor 62 in-stroke rotates the latch lever 66 about pivot pin 67 thereby shifting the position of eccentrically located, oversized wedge bore 69 in latch hook 64 relative to the wedge journal 68 which extends through the parallel bars of the swing arm 60. Such relative shift between journal 68 and bore 69 releases the wedging force of hook 64 against the latch bar 65. Continued motor 62 in-stroke rotates the lever 66 and hook 64 assembly about the axis of wedge journal 68 to clear the hook 64 of the latch bar 65 thereby freeing the front end of swing arm 60 for rotation about and away from table 11.

Control panels 70*a* and 70*b*, illustrated only by FIG. 2 for clarity, are series connected thereby requiring both of the operator's hands simultaneously to engage a machine operation.

An operational sequence of the above described machine begins with the swing arm 60 and shear plate 40, both, in their respective upper limit positions thereby positioning the shear knives 50*a* and 50*b* above the surface of table 11. Both T-bar clamps 29 and 35 are also opened to the up position.

Shuttle carriage 20 is shifted laterally to the right to engage spacer buttons 46 and 47 between the micro-adjustable abutment surface 16 on the frame 10 under fixed bed knife 14 and the micro-adjustable abutment surface 26 under reciprocating bed knife 21. Such abutment positionment precisely aligns the reciprocating bed knife 21 relative to the cutting plane of left shear knife 50(*b*).

In this mechanical state, two strips of veneer to be joined are manually positioned on the tables 11*a*, 11*b*, parallel aligned against the respective fences 12*a*, 12*b* and under the T-bar clamps 29, 35 with the ends to be sheared over the cutting edge of bed knives 14 and 21. So positioned, the T-bar clamps 29, 35 are closed to secure the strips against misaligning movement.

Upon command of the operator, motor 43 strokes the shear plate 40 down to cut the veneer strip ends simultaneously between the respective bed knife and shear knife edges. Since the spacer buttons 46 and 47 slide freely in shear plate slots 44 and 45, the slots being cut to the translational arc of the plate 40, no interference is presented.

As the shear plate 40 approaches that position in its translational arc which completes the passage of the shear knives past the bed knives, cam plate 51 on the shear plate 40 engages the cam follower arm 52 to close limit switch 53. Such switch 53 closure initiates the retraction of shuttle motor 43 to withdraw the shuttle and veneer strip secured thereto, from the abutting position with the spacer buttons 46 and 47 thereby permitting the shear plate 40 to continue its translation down below table level.

As the cam plate 51 moves past the follower arm 52, limit switch 53 reopens to initiate extension of the shuttle motor 43 thereby moving the shuttle carriage 20 to the right again. With the spacer buttons 46 and 47 now removed along with the structure of the entire shear plate 40 assembly, the shuttle carries the reciprocating bed knife 21 edge into abutment with the cutting edge of fixed bed knife 14. This position also abuts the newly cut edges of the respective veneer strips.

With the parallel cut veneer strip edges in abutting position, the desired heat cured lap splice material is positioned over the butt joint, it being understood that the strips were positioned facedown on the table 11. Hence, the lap splice is laid against the veneer strip backside.

Several alternative material systems are available for the splice such as fiberglass cloth or matt preimpregnated with epoxy or polyester resin. Another system is a fiberglass tape coated on one side with hot-melt adhesive. In either case, a structurally sound splice across the butt joint is obtained within a few seconds under the heat and pressure of the plate 61.

With the adhesive and splice system appropriately positioned, motor 62 is actuated to extend the action rod thereby rotating the swing arm down against the strip joint. As the pressure plate 61 engages the splice surface, torque is transmitted to the lever/hook assembly to rotate the hook 64 into engagement with the latch bar 65. Final extension of the motor 62 wedges the hook tightly in place and multiplies the pressure force on the strips.

Under the heat and pressure of the pressure plate 61, the splice joint is quickly cured and ready for release.

Swing arm motor 62 is reversed for rod retraction which first, unlatches the lever/hook assembly from the latch bar 65. Further motor rod retraction rotates the swing arm 60 and pressure plate 61 assembly away from the table 11 to release the newly formed splice joint.

Subsequent release of the T-bar clamps 29 and 35 completely frees the veneer strip unit from the machine for further disposition which may include a longitudinal reeling of the strip length which grows with each added increment.

Accordingly, the short, 10 feet for example, veneer strip length added from the left side of the machine is advanced to the right side until the trailing end thereof is clear of the cutting edge of fixed bed knife 14.

The operator next shifts the shuttle carriage 20 to the left and lifts the shear plate assembly 40 to the starting position with the shear knives 50 poised above the table surface 11. The shuttle carriage 20 is returned to the right until the abutment surface 26 thereof engages spacer buttons 46 and 47 which have returned by gravity to the bottom limits of guide slots 44 and 45.

The cycle is now complete and the machine ready for positionment of the next veneer strip increment to be added to the growing continuity.

Having fully described by invention, certain alternatives to mechanical details and subcombinations will readily occur to those of ordinary skill in the art. As my invention, however,

I claim:

1. A method of joining ends of two finite length sheets of material having substantially the same thickness comprising the steps of:

a. longitudinally aligning said two sheets in the same plane with the ends to be jointed positioned over respective cutting edges of separated, parallel bed knives at a first position of separation and under respective cutting edges of a structurally unitized, vertically reciprocable shear knife in a pre-cut position, said bed knife and shear knive cutting edges being below and above each of said two sheets respectfully, and defining respective shear planes;

b. positionally securing said sheets to said bed knives in said alignment;

c. first moving said shear knife cutting edges unidirectionally in said respective shear planes against and through said sheets from said pre-cut position to a post-cut position clear of said sheets and bed knives;

d. while said reciprocable shear knive remains in said post-cut position, moving the cutting edge of one bed knife parallel along said sheet plane from said first separated edge position to a contiguous bed knive edge position in contiguous parallel alignment with the cutting edge of the other bed knife without disturbing the alignment of said sheets relative to said bed knife cutting edges;

e. adhesively applying lap splice material across a joint between said sheared sheet ends;

f. releasing said two sheets from said bed knives;

g. removing said joined sheets from within the two shear planes;

h. returning said bed knife edges from said contiguous edge position to a second separated edge position having a greater separation space than said first separated edge position; and i. returning said shear knife edges to said pre-cut position.

2. A method as described by claim 1 wherein said first bed knife separated edge position is determined by abutment of said one bed knife with a gauging structure between said two bed knives.

3. A method as described by claim 2 wherein said gauging structure between said bed knives is removed to allow said contiguous edge position.

4. A method as described by claim 2 wherein said gauging structure between said bed knives is removed to allow completion of said shear knife movement to said post-cut position.

* * * * *